United States Patent [19]

Niimi

[11] 4,084,472

[45] Apr. 18, 1978

[54] ELECTRONIC MUSICAL INSTRUMENT WITH TONE GENERATION BY RECURSIVE CALCULATION

[75] Inventor: Koji Niimi, Hamamatsu, Japan

[73] Assignee: Nippon Gakki Seizo Kabushiki Kaisha, Hamamatsu, Japan

[21] Appl. No.: 758,913

[22] Filed: Jan. 13, 1977

[30] Foreign Application Priority Data

| | | |
|---|---|---|
| Jan. 14, 1976 | Japan | 51-3322 |
| Jan. 14, 1976 | Japan | 51-3323 |
| Jan. 14, 1976 | Japan | 51-3324 |

[51] Int. Cl.[2] ..... G10H 1/02; G10F 1/00

[52] U.S. Cl. ..... 84/1.01; 84/1.03; 84/1.11; 84/1.19

[58] Field of Search ..... 84/1.11, 1.12, 1.19, 84/1.21, 1.01, 1.03

[56] References Cited

U.S. PATENT DOCUMENTS 4,026,179 5/1977 Futamase ..... 84/1.24

*Primary Examiner*—Robert K. Schaefer
*Assistant Examiner*—Leonard W. Pojunas, Jr.
*Attorney, Agent, or Firm*—Cushman, Darby & Cushman

[57] ABSTRACT

A digital type electronic musical instrument generates a tone signal consisting of a plurality of time-varying partial tone signals each by recursive calculation. A recursive calculator is of a simplified construction by arranging the amplitude term to be excluded from the recursive calculation and to be multiplied thereafter. A remarkable reduction in the memory units can be accomplished by arranging the pair of initial values for each partial tone function to be equal to each other by the introduction of a phase term into the periodic part of the partial tone function.

8 Claims, 8 Drawing Figures

ELECTRONIC MUSICAL INSTRUMENT WITH TONE GENERATION BY RECURSIVE CALCULATION

BACKGROUND OF THE INVENTION (a) Field of the Invention

This invention relates to an electronic musical instrument and more particularly to an electronic musical instrument of a digital type which produces a tone signal by recursive calculation.

(b) Description of the Prior Art

Recently, such an electronic musical instrument has been developed that can produce not only the stationary musical tones, the tone pitch, the tone volume and the tone color of which are constant with respect to the lapse of time but also non-stationary musical tones, e.g., those of natural musical instruments, the tone pitch, the tone volume and the tone color of which vary in a complicated way with time. An electronic musical instrument provided with a recursive calculator was proposed for achieving generation of such complicated tones. (for example, U.S. Pat. application Ser. No. 689867)

Generally, a musical tone is considered to be a superposition of partial tones of particular frequencies (harmonics). Therefore, in the above type electronic musical instrument, a musical tone is divided into a plurality (M components) of partial tones $f_m(t)$ ($m=1, 2, \ldots, M$), the sample values $f_m(nT)$($n=0, 1, 2, \ldots$ and T is the sampling period) of the respective partial tones are calculated independently and recursively and the sum of the M partial tone sample values is calculated at each sampling time $t = nT$.

The recursive calculation for producing a partial tone function for constituting the partial tone of a musical tone is usually achieved in the following way. Namely, the recursive calculations perform calculations as:

$$f_m(nT) = p_m \cdot f_m[(n-1)T] + q_m \cdot f_m[(n-2)T] \tag{1}$$

where $p_m$ and $q_m$ are constants, or more generally $$f_m(nT) = \sum_{k=1}^{K} a_k f_m[(n-k)T] \tag{2}$$

In formula (1), the sample value $f_m(nT)$ of the $m$-th partial tone at time $t = nT$ is calculated from the preceding two sample values $f_m[(n-1)T]$ and $f_m[(n-2)T]$ of the same $m$-th partial tone at time $t = (n-1)T$ and $t = (n-2)T$ respectively, i.e., multiplying the respective recursion coefficients $p_m$ and $q_m$ and adding them together. Formula (2) represents a generalized form.

In such recursive calculation, the shapes of the partial tone functions can be varied widely depending on the selection of the parameters $p_m$ and $q_m$ and the initial values $f_m(0)$ and $f_m(T)$. In a preferred form, the recursive calculation is achieved in the following way.

For generating each of the partial tone functions $$f_m(t) = a_m \cdot \exp(\alpha_m t) \cdot \cos(\omega_m t) \tag{3}$$

according to the recursive calculation of formula (1), the two initial values are selected to be $$\left.\begin{aligned} &f_m(0) = a_m \text{ and} \\ &f_m(T) = a_m \cdot \exp(\alpha_m T) \cdot \cos(\omega_m T), \end{aligned}\right\} \tag{4}$$

and the coefficients are selected to be $$\left.\begin{aligned} &p_m = 2 \cdot \exp(\alpha_m T) \cdot \cos(\omega_m T) \text{ and} \\ &q_m = -\exp(2\alpha_m T). \end{aligned}\right\} \tag{5}$$

Then, formula (1) leads to $$\left.\begin{aligned} f_m(2T) &= p_m \cdot m(T) + q_m \cdot f_m(0) \\ &= 2\exp(\alpha_m T)\cos(\omega_m T) \cdot a_m \exp(\alpha_m T)\cos(\omega_m T) \\ &\quad - \exp(2\alpha_m T) \cdot a_m \\ &= a_m \exp(2\alpha_m T)[2\cos^2(\omega_m T) - 1] \\ &= a_m \exp(2\alpha_m T)\cos(2\omega_m T) \\ f_m(3T) &= p_m \cdot f_m(2T) + q_m \cdot f_m(T) \\ &= 2\exp(\alpha_m T)\cos(\omega_m T) \cdot a_m \exp(2\alpha_m T)\cos(2\omega_m T) \\ &\quad - \exp(2\alpha_M T) \cdot a_m \exp(\alpha_m T)\cos(\omega_m T) \\ &= a_m \exp(3\alpha_m T)[2\cos(\omega_m T)\cos(2\omega_m T) - \cos(\omega_m T)] \\ &= a_m \exp(3\alpha_m T)\cos(3\omega_m T), \text{ and} \\ f_m(nT) &= p_m \cdot f_m[(n-1)T] + q_m \cdot f_m[(n-2)T] \\ &= 2\exp(\alpha_m T)\cos(\omega_m T) \cdot \\ &\quad a_m \exp[(n-1)\alpha_m T)\cos[(n-1)\omega_m T] \\ &\quad -\exp(2\alpha_m T) \cdot a_m \exp[(n-2)\alpha_m T]\cos[(n-2)\omega_m T] \\ &= a_m \exp(n\alpha_m T)\{2\cos(\omega_m T)\cos[(n-1)\omega_m T] \\ &\quad -\cos[(n-2)\omega_m T]\} \\ &= a_m \exp(n\alpha_m T)\cos(n\omega_m T). \end{aligned}\right\} \tag{6}$$

Here, the relation $$\left.\begin{aligned} &2\cos(T) \cdot [(n-1)T] - \cos[(n-2)T] \\ &\quad = [\exp(iT) + \exp(-iT)] \cdot \{\exp[i(n-1)T] \\ &\quad + \exp[-i(n-1)T]\}/2 \\ &\quad - \{\exp[i(n-2)T] + \exp[-i(n-2)T]\}/2 \\ &\quad = [\exp(inT) + \exp(-inT)]/2 \\ &\quad = \cos(nT) \end{aligned}\right\} \tag{7}$$

is used.

Such operations are achieved for the respective partial tones (practically in time-sharing manner) and added together to compose a sample value of the total musical tone F($t$) at each sample time. Namely, $$\left.\begin{aligned} F(0) &= \sum_{m=1}^{M} f_m(0) = \sum_{m=1}^{M} a_m \\ F(T) &= \sum_{m=1}^{M} f_m(T) = \sum_{m=1}^{M} a_m \exp(\alpha_m T)\cos(\omega_m T) \\ F(2T) &= \sum_{m=1}^{M} f_m(2T) = \sum_{m=1}^{M} a_m \exp(2\alpha_m T)\cos(2\omega_m T) \\ F(nT) &= \sum_{m=1}^{M} f_m(nT) = \sum_{m=1}^{M} a_m \exp(n\alpha_m T)\cos(n\omega_m T). \end{aligned}\right\} \tag{8}$$

As can be seen from the above description, the electronic musical instrument for generating musical tones by the above recursive calculation includes a recursive calculator for achieving the recursive calculations, recursion coefficient memory for storing M pairs of independent coefficients, $p_m$ ($m=1$ to M) and $q_m$ ($m=1$ to M), and initial value memory means for storing M pairs of independent initial function values, $f_m(0)$ ($m=1$ to M) and $f_m(T)$ ($m=1$ to M).

In such an electronic musical instrument, the amplitude $a_m$ of each partial tone $f_m(t)$ can be independently determined by the initial value $f_m(0) = a_m$, and the tone pitch and the envelope are determined by the other initial value and the two coefficients. Particularly, the envelope may be arranged constant by setting the coefficient $\alpha_m$ to be zero, attenuating by setting the coefficient $\alpha_m$ to be negative and diverging by setting the coefficient $\alpha_m$ to be positive. Thus, various modifications of the tone envelope can be performed according to this method. Therefore, it can be expected that such an electronic musical instrument can produce musical tones resembling close to the musical tones of the natural musical instruments.

Generally, the amplitudes of the respective partial tones of a musical tone differ from each other. Thus, when the number (M) of partial tones is large, the number (2M) of initial value memory elements for setting these partial tones also becomes very large.

Further, there exists further problem in synthesizing some kinds of musical tones, for example those of the piano, according to the above method. Namely, the amplitudes of the musical tones of the piano differ much in the higher pitch range and the lower pitch range and also they vary greatly by the depression strength of the key. Even considering piano tones of a particular pitch range, the amplitudes of the higher harmonics and the lower harmonics differ greatly. Thus, for insuring high fidelity production of piano tones, the initial value memories should store an extensively wide range of amplitudes, from the minimum to the maximum. This requires a large number of bits for each of the initial value memory units and the registers and the memories in the calculation circuit. Then, the scale of the calculator and hence the electronic musical instrument itself should inevitably becomes large.

SUMMARY OF THE INVENTION

Therefore, the present invention is intended to simplify or scale-down the structure of the electronic musical instrument of a digital recursive calculation type.

An object of this invention is to provide an electronic musical instrument having a simple structure of small scale and capable of producing both the stationary and the non-stationary tones resembling the tones of a natural musical instrument.

Another object of this invention is to provide a recursive calculation type electronic musical instrument having a simple structure and capable of generating various kinds of tones resembling the musical tones of a natural musical instrument.

Before the description of the preferred embodiments, the basic concepts of this invention will be described hereinbelow.

As has been described above, the problem lies at least partially in the wide range of the change in the amplitude of the respective partial tones and the calculation of such wide range values in the recursive calculation. The present inventor has found that, as can be seen from formulae (3) to (6), the amplitude term $a_m$ need not be included in the recursive calculation. Namely, some kind of normalized partial tone functions may be calculated in the recursive calculation and then the amplitude coefficients may be multiplied. This can be done by replacing the amplitude term $a_m$ in formulae (4) (initial value) and (6) (recursive calculation) with a common constant $a_0$ and multiplying the resultant partial tone functions by the amplitude term $(a_m/a_0)$. This arrangement provides an advantage that the circuit components of the recursive calculator can be simplified from the point of bit.

Further, the present inventor has found that the relation (7) still holds even when the origin of the time periodicity is displaced. Namely, $$\left.\begin{aligned} &2\cos(T)\cdot\cos[(n-1)T+t_0]-\cos[(n-2)T+t_0] \\ &= [\exp(iT)+\exp(-it)]\cdot\{\exp[i(n-1)T+it_0] \\ &\quad+\exp[-i(n-1)T-it_0\}/2 \\ &\quad-\{\exp[i(n-2)T+it_0]+\exp[-i(n-2)T=it_0]\}/2 \\ &= \{\exp[i(nT)+t_0]+\exp[-(nT+t_0]\}/2 \\ &= \cos(nT+t_0)\,. \end{aligned}\right\} \quad (7')$$

This implies that if one introduces the phase shift $t_{m0}$ the partial tone function $$f_{m0}(t) = a_0\exp(\alpha_m t)\cdot\cos(\omega_m t + t_{m0}) \quad (3')$$

can be arranged to take a similar value at two sampling points $t = 0$ and $t = T$ by the adjustment of the phase term $t_{m0}$. Actually, it was found that such phase shift in the sinusoidal function of the respective partial tones gives little influence to the audible sense of the human being.

In one case, the initial values can be selected as $$\left.\begin{aligned} f_{m0}(0) &= a'_m\cos(t_{m0}) = a'_0 \\ f_{m0}(T) &= a'_m\exp(\alpha_m T)\cos(\omega_m T + t_{m0}) = a'_0 \end{aligned}\right\} \quad (4')$$

and the regression coefficients are selected as $$\left.\begin{aligned} p_m &= 2\exp(\alpha_m T)\cos(\omega_m T) \\ q_m &= -\exp(2\alpha_m T) \end{aligned}\right\} \quad (5)$$

Then, $$\left.\begin{aligned} f_{m0}(2T) &= 2a'_m\exp(2\alpha_m T\cos(\omega_m T)\cos(\omega_m T + t_{m0}) \\ &\quad - a'_m\exp(2\alpha_m T)\cos(t_{m0}) \\ &= a'_m\exp(2\alpha_m T\cos(2\omega_m T + t_{m0})\,, \\ &\;\;\vdots \\ f_{m0}(nT) &= a'_m\exp(n\alpha_m T)\cos(n\omega_m T + t_{m0}), \end{aligned}\right\} \quad (6')$$

Then, the initial value memories can be replaced by a simple group of amplitude memories, i.e., reduced to one half.

Thus, this arrangement enables remarkable reduction in the memory capacity of the digital recursive calculation type electronic musical instrument.

Further objects, features and advantages of this invention will become apparent from the following description of the preferred embodiments, when taken in conjunction with the accompanying drawings.

DESCRIPTION OF THE PREFERRED EMBODIMENTS

Figure 1:
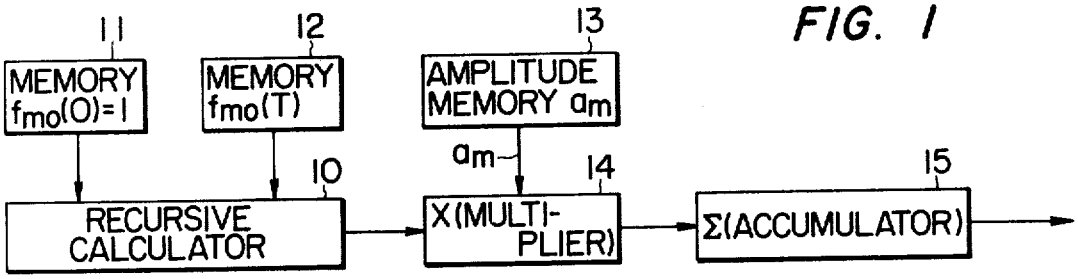
FIG. 1 is a partial block diagram of a basic circuit of an electronic musical instrument for generating a tone signal by the recursive calculation of respective partial tone signals according to an embodiment of this invention.
Figure 2:
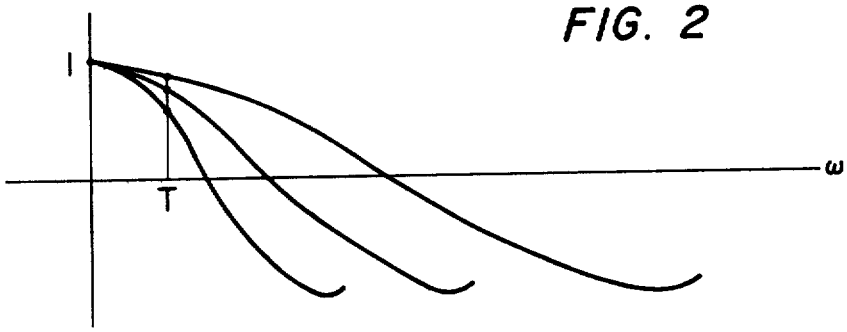
FIG. 2 is a waveshape diagram showing several normalized partial tone functions of different tone pitch generated in the circuit of FIG. 1.

FIG. 1 shows a basic embodiment in which the amplitude term $a_m$ in the partial tone function $a_m \exp(\alpha_m t) \cdot \cos(\omega_m t)$ is arranged to be multiplied after the recursive calculation. A recursive tone generator includes a recursive calculator 10 for achieving the recursive calculation which generates, from the outputs of a first memory means 11 and a second memory means 12 for storing the first and second sets of initial values, normalized partial tone functions $$\left.\begin{aligned} f_{10}(t) &= \exp(\alpha_1 t)\cos(\omega_1 t) \\ f_{20}(t) &= \exp(\alpha_2 t)\cos(\omega_2 t) \\ &\vdots \\ f_{M0}(t) &= \exp(\alpha_M t)\cos(\omega_M t) \end{aligned}\right\} \quad (9)$$

which take the initial value "1" at time $t = 0$ as can be easily seen from the formulae. Thus, the initial values at $t = 0$ for all the partial tones become common ($f_{10}(0) = f_{20}(0) = \ldots = f_{M0}(0) = 1$). This means that the first initial value memory 11 for giving the initial value at $t = 0$ can be some means for supplying a constant value, i.e., need not be the so-called memory.

The second set of initial values at $t = T$ is supplied from the second memory means 12 including M independent memory elements for the M partial tones since the second initial values at $t = T$ are usually different depending on the respective frequencies $\omega_i$ and the respective envelope-defining terms $\exp(\alpha_i t)$.

The recursive calculator 10 calculates the value of the respective partial tones $\exp(\alpha_i t)\cdot\cos(\omega_i t)$ at $t = nT$ from the initial values stored in the memory means 11 and 12 and the calculated values stored in the registers in the recursive calculator 10. After the generation of the normalized partial tone signals in the recursive calculator 10, the respective outputs of the recursive calculator 10 corresponding to the partial tones are multiplied with the respective amplitudes $a_i$ to $a_M$ stored in the amplitude memory 13 in a multiplier 14. Then, the sample values of the desired partial tone functions at respective sampling times are obtained as $$\left.\begin{aligned} f_1(t) &= a_1 \exp(\alpha_1 t)\cos(\omega_1 t) \\ f_2(t) &= a_2 \exp(\alpha_2 t)\cos(\omega_2 t) \\ &\vdots \\ f_M(t) &= a_M \exp(\alpha_M t)\cos(\omega_m t). \end{aligned}\right\} \quad (10)$$

These sample values at each sampling time are accumulated in an accumulator 15 to generate a musical tone $$F(t) = \sum_{m=1}^{M} f_m(t)$$

at predetermined timing.

According to this embodiment, the partial tone functions are first calculated in normalized form and then amplitudes are multiplied by the normalized functions. Therefore, the registers, etc., in the calculator 10 need only to deal with the numerical values of a particular range and hence the bit number of such registers, etc., in the calculator can be reduced considerably.

Figure 3:
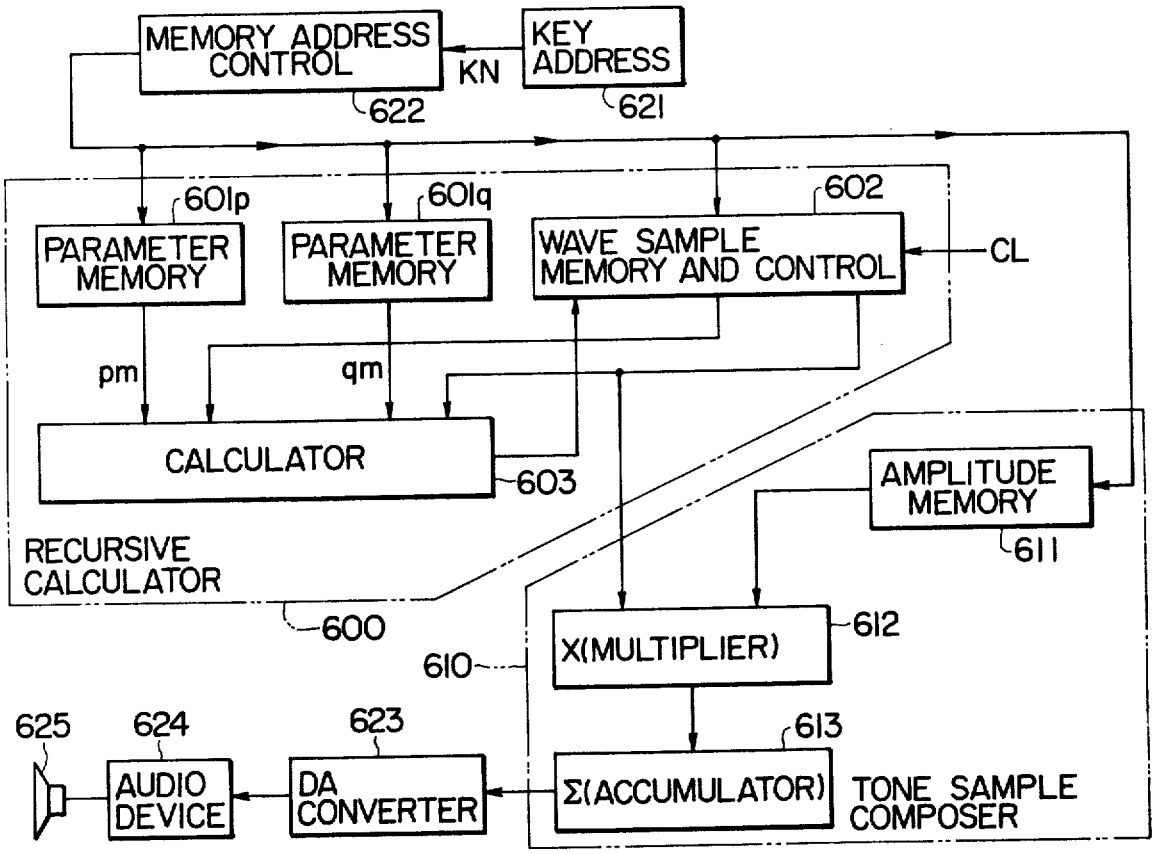
FIG. 3 is a block diagram of a circuit of an electronic musical instrument embodying an embodiment of this invention.

FIG. 3 shows a total structure of an electronic musical instrument embodying the basic structure of FIG. 1. In the figure, key address generator 621 and memory address control means 622 are actuated by the depression of a key in a keyboard (not shown) and drive recursive calculator 600 and tone sample composer 610. The sample values of the musical tone derived from the tone sample composer 610 are supplied to a digital-analog (DA) converter 623 to transform into an analog signal and sounded as musical tones from a loudspeaker system 625 through an audio device 624.

More detailed description will be made hereinbelow of each component of the apparatus. The key address generator 621 generates a key number signal KN representing the depressed key in the keyboard from a memory formed of read-only-memory (ROM), etc., and supplies it to the memory address control means 622. The memory address control means 622 is actuated by the key number signal KN and drives the recursive calculator 600 and the tone sample composer 610 to read out the parameters and the initial values required for calculating the sample values of the musical tone.

The recursive calculator 600 includes a first parameter memory **601*p*, a second parameter memory 601*q*, a wave sample memory and control circuit 602 and a calculator 603 for performing the recursive calculation. The parameter memories 601*p* and 601*q* store two sets of parameters $p_m$ and $q_m$ ($m = 1$ to M), respectively, the number M corresponding to the number of partial tones. A corresponding pair of parameters $p_m$ and $q_m$ are read out from the parameter memories 601*p* and 601*q* by the output of the memory address control 622** responding to each key depression.

The wave sample memory and control circuit 602 includes initial value memories (corresponding to the initial value memories 11 and 12 in FIG. 1) for storing two groups of initial values $f_{m0}(0)$ and $f_{m0}(T)$ ($m = 1$ to M) and registers for storing preceding two groups of calculated sample values $f_{m0}[(n-1)T]$ and $f_{m0}[(n-2)T]$ for supplying the preceding two sample values of the partial tone signals under operation to the calculator 603. Upon calculation of a new sample value $f_{m0}(nT)$ in the calculator 603, the memory and control circuit 602 stores this new value and erase one older memory $f_{m0}[(n-2)T]$. The memory and control circuit 602 also supplies the calculated sample values to the tone sample composer 610 at a constant period $\tau$. When the number of partial tones is M and the sampling period of the musical tone is T as described above, the period $\tau$ for supplying one partial tone sampling value is $\tau = T/M$ and the memory and control circuit 602 supplies the partial tone sample values $f_{10}(0), f_{20}(0), \ldots, f_{M0}(0), f_{10}(T), f_{20}(T), \ldots, f_{M0}(T), f_{10}(2T), f_{20}(2T), \ldots$ successively at a period $\tau$ to the musical tone sampling means 610. Here, while supplying the sample values $f_{10}(0)$ to $f_{M0}(0)$ to the tone sample composer 610, the memory and control circuit 602 also transfers the sample (or initial) values $f_{m0}(0)$ and $f_{m0}(T)$ to the calculator 603 and then stores the calculated sample values $f_{m0}(2T)$ temporarily. In the next cycle [$t = M\tau$ to $(2m-1)\tau$], the memory and control circuit 602 supplies the sample values $f_{m0}(T)$ to the tone sample composer 610 and simultaneously the sample values $f_{m0}(T)$ and $f_{m0}(2T)$ to the calculator 603, and receives the calculated sample values $f_{m0}(3T)$. Similar operations follow to supply the sampling values $[f_{m0}(0)]$, $[f_{m0}(T)]$, $[f_{m0}(2T)]$, ... to the tone sample composer. The formation of these normalized partial tone sampling values $[f_{m0}(nT)]$ is initiated by the output signal of the memory address control 622 similar to the operation of the parameter memories **601*p* and 601*q* and terminated by a clear signal CL (generated, for example, upon detection of a new key depression signal). The content of the memory and control means 602** is cleared by this clear signal for preparing a new operation.

The calculator 603 includes multipliers and an adder, receives the parameters $p_m$ and $q_m$ from the parameter memories 601p and 601q and the preceding sample values $f_{m0}[(n-1)T]$ and $f_{m0}[(n-2T]$ from the memory and control circuit 602 and calculates a new sample value $f_{m0}(nT) = p_m \cdot f_{m0}[(n-1)T] + q_m \cdot f_{m0}[(n-2)T]$.

The tone sample composer 610 includes a memory 611 for storing the relative amplitudes $a_m(m=1$ to M) of the partial tones, a multiplier 612 for multiplying the normalized partial tone sample value $f_{m0}(nT)$ by the amplitude $a_m$, and the accumulator 613 for accumulating a predetermined group of the outputs of the multiplier 612 to compose a musical tone sample value $$F(nT) = \sum_{m=1}^{M} a_m \cdot f_{m0}(nT).$$

Here, the amplitude memory 611 reads out a predetermined amplitude $a_m$ under the control of the output signal of the memory address control 622 in synchronism with the operation of the wave sample memory and control circuit 602 so that a predetermined pair of the sample value $f_{m0}(nT)$ and the amplitude $a_m$ is multiplied in the multiplier 612. All the partial tones $[a_m \cdot f_{m0}(nT]$ at one sampling time $t = nT$ are accumulated in the accumulator 613 to generate one sample value of the musical tone wave $$F(nT) = \sum_{m=1}^{M} f_m(nT) = \sum_{m=1}^{M} a_m \cdot f_{m0}(nT).$$

Such sample values are supplied to the DA converter 623 and sounded in the loudspeaker system 625 through the audio device 624.

Figure 4:
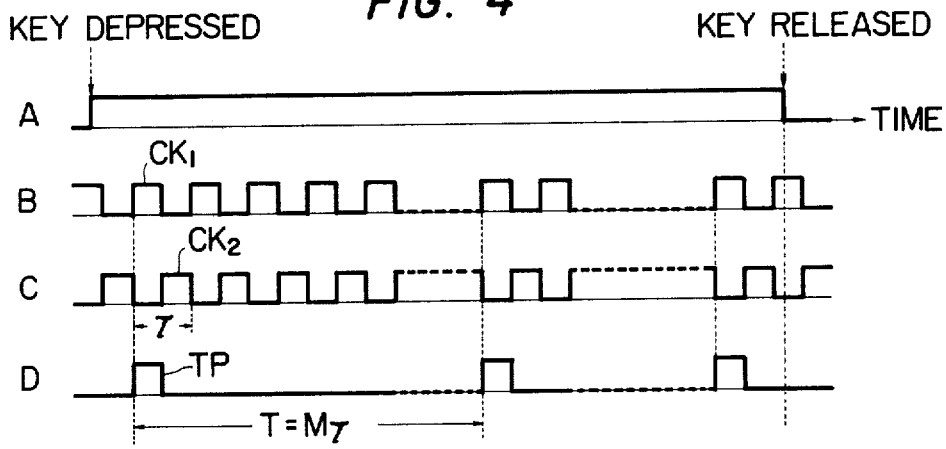
FIG. 4 is a timing chart for explaining the operation of the circuit of FIG. 3.

The control of the operation of the circuit of FIG. 3 is effected synchronously by clock pulses $CK_1$ and $CK_2(=\overline{CK}_1)$ having one half duty and a period of $\tau = T/M$, and a timing pulse TP having a period T as shown in the timing chart of FIG. 4. As can be seen from the foregoing description, the timing pulse period T determines the time length of one cycle for composing one musical tone sample and the period $\tau$ determines the period for generating each one partial tone sample value. Namely, the pulse $CK_1$ controls the read-out of the data from the memories 601p and 601q and from the memory and control circuits 602, and the complementary pulse $CK_2$ controls the write-in of the calculated data of the calculator 603 into the memory and control circuit 602. The sample values of the partial tones thus formed are supplied to the accumulator 613 and form the sample values of the musical tone $$F(nT) = \sum_{m=1}^{M} a_m \cdot f_{m0}(nT).$$

at a period of T under the control of the timing pulse TP. In the figure, waveshape A represents a key depression signal which rises upon the depression of a key and falls upon the release thereof. As described above, a clear signal CL may be formed upon detection of the fall of the key depression signal.

Figure 5:
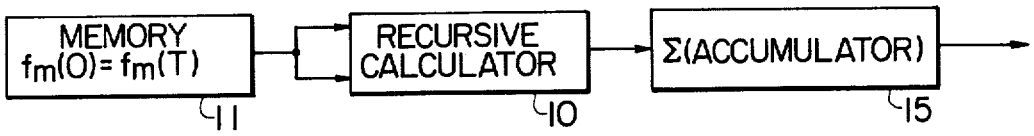
FIG. 5 is a partial block diagram of a circuit of an electronic musical instrument of a recursive calculation type according to another embodiment of this invention.
Figure 6:
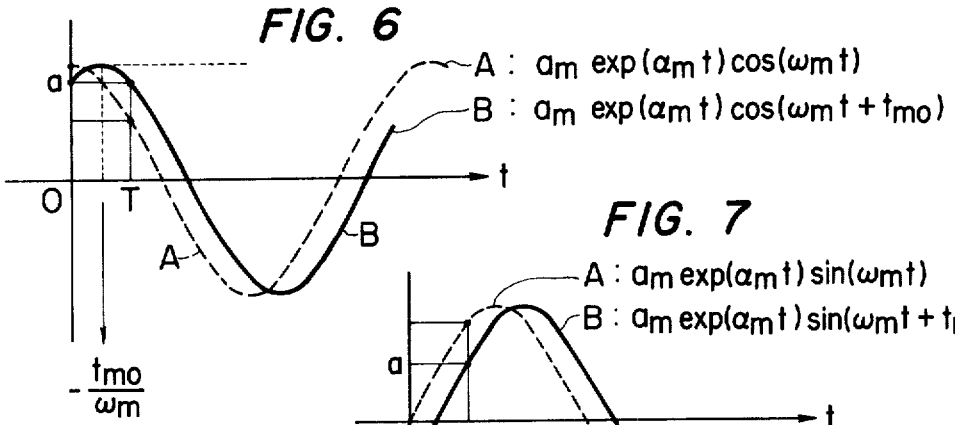
FIGS. 6 and 7 are waveshape diagrams showing the effect of phase shift term in a partial tone function.

FIG. 5 shows another embodiment in which the initial values of each partial tone signal at $t = 0$ and $t = T$ are arranged to be equal by the adjustment of the phase term. Namely, a group of partial tone signals $$\left.\begin{aligned} f_1(T) &= a_1 \exp(\alpha_1 t) \cos(\omega_1 t + t_{10}) \\ f_2(t) &= a_2 \exp(\alpha_2 \cos(\omega_2 t + t_{20}) \\ &\vdots \\ f_M(t) &= a_M \exp(\alpha_M t) \cos(\omega_M t + t_{M0}) \end{aligned}\right\} \quad (11)$$

is to be generated by the recursive calculation based on the initial values $f_1(0) = f_1(T), f_2(0) = f_2(T), \ldots, f_M(T)$. The equalization of the two initial values are achieved by appropriately selecting the phase shift term $t_{m0}$. Namely, from equations $$f_m(0) = a_m \cdot \cos(t_{m0}),$$

$$f_m(T) = a_m \exp(\alpha_m T) \cdot \cos(\omega_m T + t_{m0}), \text{ and}$$

$$f_m(0) = f_m(T),$$

the phase shift $t_{m0}$ can be determined. This procedure may be easily seen from FIG. 6. In FIG. 6, a broken curve A represents a partial tone function $f_m(t)$ of the formula (11) with no phase shift $t_{m0} = 0$, in which case formula (11) reduces to formula (3). By the introduction of a phase shift $t_{m0} \neq 0$, the curve is changed as shown by the solid curve B. Here, if the term $\exp(\alpha_m T)$ can be approximated to be unity, the curve B is only a translated version of the curve A. The phase shift $t_{m0}$ is selected at a value at which the values of $f_m(t)$ at $t = 0$ and $t = T$ are equal. A group of such determined initial values are stored in a memory 11. A recursive calculator 10 performs the recursive calculations based on such determined initial values stored in the memory 11 and the recursive parameters similar to those of the case of FIG. 1. The operation will be apparent from formulae (7') and (6'). In this embodiment, since the amplitude information is included in the initial value data $f_m(0) = f_m(T)$, there is no need for multiplying the amplitude after the recursive calculation and the tone signal can be formed simply by accumulating the partial tones, $F(t) = \Sigma f_m(t)$. Yet, the number of memory elements can be reduced into one half of the conventional case.

Figure 7:
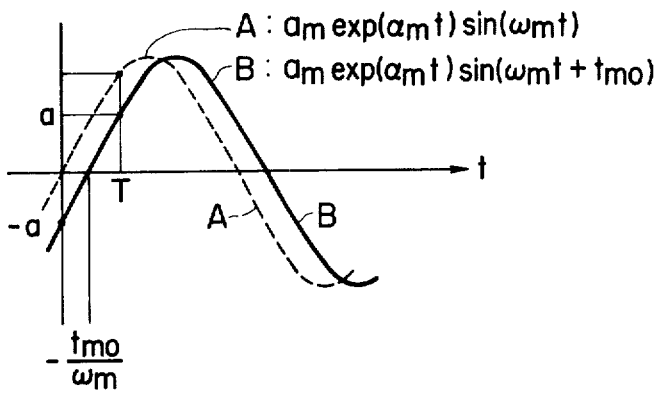

FIG. 7 shows an alternative method of introducing a phase shift term. In this case, a tone signal is represented by a sine curve rather than a cosine curve. The original tone signal curve A is modified into the curve B by the phase shift so that the value of the function $f_m(t)$ takes two values having opposite signs but the same absolute value.

Figure 8:
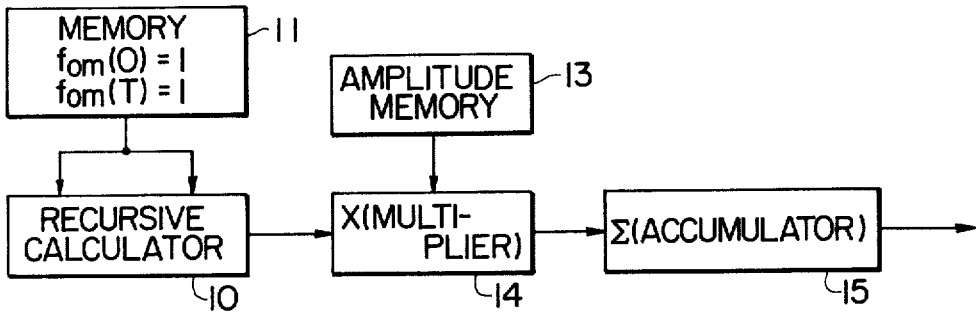
FIG. 8 is a partial block diagram of a circuit of an electronic musical instrument of a recursive calculation type according to still another embodiment of this invention.

FIG. 8 shows another embodiment in which phase shift term is introduced for equalizing the two initial values of each partial tone function at $t = 0$ and $t = T$ and also the amplitudes of the respective partial tone functions at $t = 0$ and $t = T$ are normalized. In the figure, the circuit structure resembles that of FIG. 1 except that the initial value memories 11 and 12 are substituted by an initial value memory 11 which supplies unity (or some convenient constant) to the calculator 10.

The calculator 10 generates partial tone functions $$f_{m0}(nT) = a'_m \exp(n\alpha_m T) \cos(n\omega_m T + t_{m0}). \quad (6')$$

Thus, the initial value memory 11 should supply $$\left.\begin{aligned} f_{m0}(0) &= a'_m \cos(t_{m0}) = a'_0 \text{ and} \\ f_{m0}(T) &= a'_m \exp(\alpha_m T) \cos(\omega_m T + t_{m0}) = a'_0 \end{aligned}\right\} \quad (4')$$

The value $a'_0$ is selected to be unity by adjusting $a'_m$ and $t_{m0}$. As described before, the recursive calculation can be achieved by selecting the recursion coefficients $p_m$ and $q_m$ to be $$\left.\begin{aligned} p_m &= 2 \exp(\alpha_m T) \cos(\omega_m T) \text{ and} \\ q_m &= -\exp(2\alpha_m T) . \end{aligned}\right\} \quad (5)$$

By multiplying the amplitude term $a_m/a_0$ to the output of the operation circuit 10 in the multiplier 14, a group of partial tone functions $$f_m(t) = a_m \exp(\alpha_m t) \cos(\omega_m t + t_{m0}) \quad (12)$$

is provided. The accumulator takes the sum of such partial tone functions and generates a musical tone signal $$F(t) = \sum_{m=1}^{M} f_m(t) .$$

In this embodiment, the recursive calculation treats only the normalized partial waves and the initial value memory 11 supplies only unity. Therefore, the memory 11 may not be the so-called memory and only a memory for storing M amplitude terms $[a_m/a_0]$ is required. Further, the number of bits for the registers, etc., in the calculation circuit may be reduced.

The embodiments of FIGS. 5 and 8 can be brought into a practical form similar to the structure of FIG. 8 which embodies the circuit of FIG. 1.

As described above, the bit number in the recursive calculator and/or the number of memory elements can be greatly reduced according to this invention.

I claim:

1. An electronic musical instrument having digital recursive calculation means and capable of generating a superposition of a group of partial tones comprising:

a recursive calculating circuit for calculating partial tone functions from a pair of initial values and a pair of recursion parameters predetermined for each of the partial tone functions;

initial value memory means for supplying said pairs of initial values for the respective partial tone functions to said recursive calculating circuit, at least each one of said pairs of initial values being a common constant for all the partial tone functions; and amplitude memory means for storing each one constant for the respective partial tone functions for compensating for the amplitude of the outputs of said regression operation circuit.

2. An electronic musical instrument according to claim 1, wherein said recursive calculating circuit calculates a group of normalized partial tone functions, said initial value memory supplies a common constant to the recursive calculating circuit as the common initial amplitudes of said respective normalized partial tone functions to be generated in said recursive gymnastics circuit.

3. An electronic musical instrument according to claim 1, wherein each of the normalized partial tone functions to be generated has an adjustable phase term and said initial value memory means supplies a common constant as the both members of said pairs of initial values by the adjustment of the amplitude and the phase term of each normalized partial tone function.

4. An electronic musical instrument having digital recursive calculating means for generating a group of partial tone functions $f_m(t) = a_m \exp(\alpha_m t) \cdot \cos(\omega_m t + t_{m0})$ at sampling time $t = nT$, where $t$ is time, $n$ a positive integer or zero, T a sampling period, $a_m$, $\alpha_m$ and $\omega_m$ are constants predetermined for the $m$-th partial tone function, and $t_{m0}$ is an adjustable phase term, the recursive calculation means includes initial value memories storing a group of pairs of initial values $f_m(0)$ and $f_m(T)$ with an adjusted phase shift $t_{m0}$ so that $f_m(0) = f_m(T)$ for each partial tone function.

5. An electronic musical instrument according to claim 4, wherein said initial values of the respective partial tone functions are all in common, $f_m(0) = f_m(T)$ = constant, and said recursive calculating means further includes an amplitude memory storing the amplitude compensating factor for each partial tone function.

6. An electronic musical instrument having digital recursive operation means for generating a group of normalized partial tone functions $f_{m0}(t) = a'_m \exp(\alpha_m t) \cdot \cos(\omega_m t + t_{m0})$ by the recursive calculation and multiplying amplitude terms $a_m/a'_m$ to the respective normalized partial tone functions $f_{m0}(t)$ to generate partial tone functions $f_m(t) = a_m \exp(\alpha_m t) \cdot \cos(\omega_m t + t_{m0})$ where $a'_m$ is an adjustable constant, $\alpha_m$, $\omega_m$ and $a_m$ are constants predetermined for each partial tone function and $t_{m0}$ is an adjustable phase shift.

7. An electronic musical instrument according to claim 6, wherein said phase shift $t_{m0} = 0$ for all the partial tone functions and said adjustable constant $a'_m$ is a constant common to all the partial tone functions.

8. An electronic musical instrument according to claim 6, wherein said adjustable constant $a'_m$ and said phase shift $t_{m0}$ has such values that the respective normalized partial tone functions take one same value at two moments $t = 0$ and $t = T$.

* * * * *